US007469168B1

(12) United States Patent
Richey

(10) Patent No.: US 7,469,168 B1
(45) Date of Patent: Dec. 23, 2008

(54) RUDDER CONTROL SYSTEM WITH ADJUSTABLE SOLENOID ON/OFF SETTINGS, SOLENOID BURNOUT PROTECTION, AND HYDRAULIC SYSTEM MONITORING

(75) Inventor: Ronald K. Richey, Charlottesville, VA (US)

(73) Assignee: Northrop Grumman Corp., Los Angeles, CA (US)

( * ) Notice: Subject to any disclaimer, the term of this patent is extended or adjusted under 35 U.S.C. 154(b) by 894 days.

(21) Appl. No.: 10/814,707

(22) Filed: Mar. 30, 2004

(51) Int. Cl.
*G05D 1/02* (2006.01)
*B63H 25/06* (2006.01)

(52) U.S. Cl. ..... 701/21; 701/224; 701/41; 701/207; 114/144 E; 114/144 R; 114/146; 114/150; 114/162; 318/588

(58) Field of Classification Search ..... 701/21; 114/144 A, 144 RE, 162, 158
See application file for complete search history.

(56) References Cited

U.S. PATENT DOCUMENTS 4,038,528 A * 7/1977 Fowler ..... 701/224
4,223,624 A * 9/1980 Iyeta ..... 114/144 E
4,374,423 A * 2/1983 Kundler et al. ..... 701/21
4,595,867 A * 6/1986 Cognevich et al. ..... 318/588
5,034,895 A * 7/1991 Johnson et al. ..... 701/224
5,107,424 A * 4/1992 Bird et al. ..... 701/21
5,179,905 A * 1/1993 Hossfield et al. ..... 114/144 E
5,313,397 A * 5/1994 Singh et al. ..... 701/224
5,331,558 A * 7/1994 Hossfield et al. ..... 701/21

FOREIGN PATENT DOCUMENTS

GB 2222971 A * 3/1990

* cited by examiner

*Primary Examiner*—Thomas G. Black
*Assistant Examiner*—Lin B Olsen
(74) *Attorney, Agent, or Firm*—Seymour Levine; Michael H. Wallach

(57) ABSTRACT

A rudder control system having adjustable rudder drive turn off and "turn on," and component wear monitoring. The rudder drive "turn off" being adjusted in accordance with the rudder stop position relative to the rudder order stop position, thereby improving position accuracy. Frequency of system "turn on" is compared to an acceptable "turn on" frequency for solenoid operation. Should the "turn on" frequency exceed the acceptable "turn on" frequency, the rudder angle at which "turn on" is implemented is adjusted to protect solenoids in the system from burnout. The rate of change of the rudder repeatback signal is monitored. A slow rate of change providing an indication of some component problem.

14 Claims, 2 Drawing Sheets

RUDDER CONTROL SYSTEM WITH ADJUSTABLE SOLENOID ON/OFF SETTINGS, SOLENOID BURNOUT PROTECTION, AND HYDRAULIC SYSTEM MONITORING

BACKGROUND OF THE INVENTION

1. Field of the Invention

The invention pertains to the field of the steering and control of a marine vessel, and more particularly to an adjustable rudder servo amplifier for accurate steering and pump solenoid longevity.

2. Description of the Prior Art

Marine vessels use rudder servo amplifiers to control solenoids to activate and deactivate hydraulic pumps which turn the rudder stock, attached to the rudders, to position the rudders. These servo amplifiers provide the signals for positioning the rudders in accordance with orders received from the helm or autopilot. Vessels having a hydraulic pump unit, with multiple hydraulic pumps, coupled to each rudder, have a rudder servo amplifier, respectively associated with each hydraulic pump unit. The gains of these amplifiers, set by the operator, are dependent on the number of on-line pumps in the unit and the performance of the of these pumps, which may change over time thereby, requiring an additional operator adjustment.

An "on-off" type hydraulic pump control directs hydraulic fluid flow to an actuator that turns the rudder stock to which the rudder is attached. When a pump is instantaneously turned "on", the hydraulic fluid is stepped from no fluid flow to maximum fluid flow. This step from no fluid flow to maximum fluid flow produces stress on the system and mechanical shock to the whole vessel. To eliminate the system stress and mechanical shock, a multi-stage pump system is utilized. The pump stages are turned on in accordance with the rudder error (rudder position relative to the rudder order) magnitude and direction, the stages being added one at a time at predetermined degree and time intervals. In a like manner stages are removed one at a time as the error is reduced. This multi-stage system provides high speed rudder motion for large rudder errors, while still maintaining the accuracy of the slower speed rudder motion at small rudder errors. Since a rudder can not be stopped instantaneously, the last pump stage is turned "off" at a predetermined rudder angle short of 0° error and the rudder is positioned by the residual movement of the rudder stock. Due to aging and other factors the predetermined "off" angle error may, not provide for the stoppage of the rudder at the desired position.

The solenoids that activate the pumps are subject to burnout when activated frequently with short time intervals between activations. AC type solenoids are more susceptible to burnout due to short time interval activations than are DC solenoids. Consequently, to prevent burnout due to repeated inrush currents in the solenoids, a time delay is imposed between successive activations of a particular solenoid. Due to the greater susceptibility of the AC solenoids, the time delays used for AC solenoids are longer than the time delays used for DC type solenoids.

In the prior art systems once a pump sequence, on/off rudder error magnitudes, and activation time delays have been established, a manual intervention is required to alter conditions should the efficiency of a pump in a stage decrease or its susceptibility to burn out increase due to ageing or other factors affecting rudder system performance change.

SUMMARY OF THE INVENTION

An object of the invention is to provide more accurate rudder positioning than that of the prior art.

Another object of the invention is to reduce wear and tear on components of the steering system.

A further object of the invention is to provide warnings of hydraulic pump deterioration.

These and other objectives of the present invention are generally provided by a rudder servo amplifier which automatically adjusts the "on" and "off" rudder error points to maintain the most accurate steering possible without either overshooting the desired position, which can cause 'hunting, or undershooting, causing decreased accuracy. The rudder order is compared to the rudder position provided by the rudder repeatback to provide an error signal. The pumps are activated when error signal exceeds a predetermined level and are turned off when a second predetermined error, near the desired rudder position, is achieved. An overshoot of the desired final position of the rudder indicates that the pump was turned off too late to allow the rudder to stop at the desired position, the rudder has stopped at an angle beyond that expected after the pump was turned off. An undershoot of the desired final rudder position indicates that the pump was turned off too soon to allow the rudder to stop at the desired position, the rudder has stopped at an angle before that expected after the pump was turned off.

Should .the rudder stop at an angle beyond the 0.0° error position, the amount of overshoot is added to the "off" point to provide a stop at the desired position. Similarly, should the rudder stop short of the 0.0° of error position, the amount of undershoot is subtracted from the "off" point. Due to normal variations in a mechanical system, these adjustments may be filtered over a time constant selected to average the stopping error at 0.0° rather than adjusting the "off" time after each overshot or undershoot occurrence.

The frequency of solenoid actuations are monitored. Should the frequency of actuations be higher than a preset acceptable actuation frequency, the 'On' time for the solenoid is set to a greater rudder error point. Since AC solenoids are more susceptible to burn out with frequent actuations than are DC solenoids, the set-up menu has a different setting for AC and DC solenoids, AC solenoid actuations being set to a lower repetition rate.

Further, the rate of change of the repeatback signal is monitored and action is taken if the rate of change is either too fast or too slow relative to the expected rate of change. The determination of an unacceptable speed is indicated to the operator by a warning message. Although a too fast rudder rate is not a normal occurrence, notification of a too slow rudder speed provides an early warning about some hydraulic problem so it can be addressed before it becomes a crisis.

BRIEF DESCRIPTION OF THE DRAWINGS

The invention will be more fully understood from the following detailed description taken in conjunction with the accompanying drawings in which.

DESCRIPTION OF THE PREFERRED EMBODIMENTS

Figure 1:
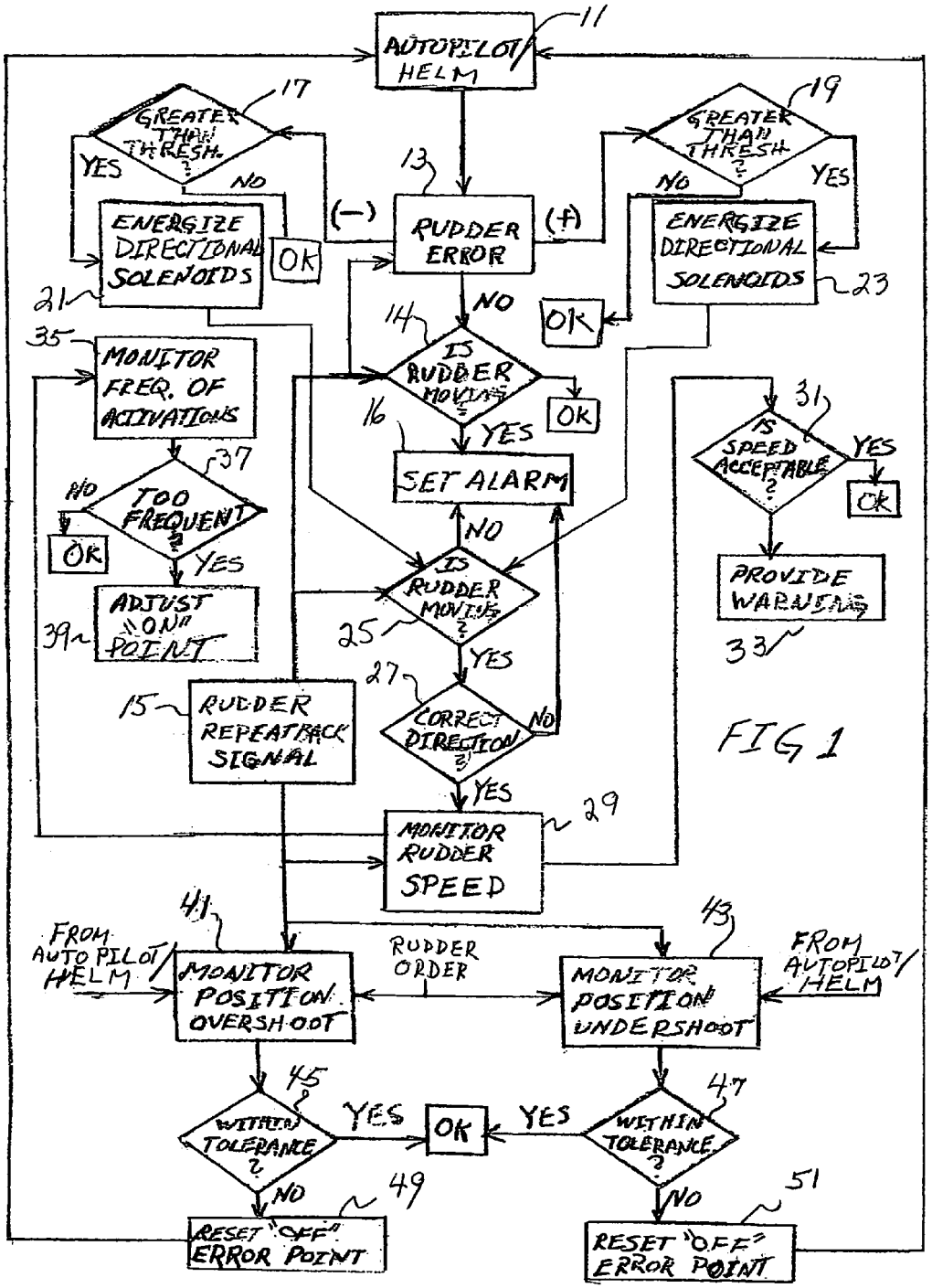
FIG. 1 is a flow diagram of the invention.

Refer now to FIG. 1. An autopilot 11 provides a rudder order to a rudder error determinator 13, to which the rudder position from the rudder repeatback 15 is also coupled. If the rudder error, the difference between the rudder order and the rudder position, is zero, or if of such small magnitude as to be considered as zero, a check of the rudder movement 14 is made. With the determination of zero rudder error and no rudder movement the rudder is properly positioned and no further action is taken. An indication of rudder movement coupled with a zero rudder error determination indicates a possible system problem and an alarm 16 is provided to the bridge.

When the rudder error is other than zero, it is compared to a specified threshold in threshold comparator 17, if the error is negative, and in threshold comparator 19, if the error is positive. When an error is negative and the threshold comparator 17 provides a determination that it does not exceed the threshold for solenoid energizing, the system operation is not altered. Should the error exceed the solenoid energizing threshold, directional solenoids are energized 21 to commence pump operation for reducing the negative rudder position error. Similarly, should the error be positive and the threshold comparator indicates that it is less than the solenoid energizing threshold, the system continues to operate without alteration. Should the error exceed the solenoid energizing threshold, directional solenoids are energized 23 to activate pumps for reducing the positive error.

After pump activation, a determination is made as to the movement of the rudder 25. When a rudder error exceeds the solenoid energizing threshold and a pump has been activated, the rudder repeatback 15 will indicate rudder movement. Should the rudder repeatback signal not indicate rudder movement, the alarm 16 is given to the bridge of a possible system malfunction. The rudder repeatback signal includes the direction of the rudder movement which is provided to a correct rudder direction indicator 27. Should the rudder be moving in the wrong direction an alarm of a possible system malfunction is issued to the bridge.

Rudder movement in the proper direction is communicated to a rudder speed and pump status unit 29 wherefrom rudder speed, which may determined from the rate-of-change of the repeatback signal, is provided to determine if the speed is acceptable 31. An acceptable speed allows the system to continue to operate without further intervention. If the rudder speed is not acceptable, too slow or too fast, a warning is provided 33 to the bridge indicating a possible fault, or component deterioration, within the hydraulic or rudder drive systems.

The frequency of solenoid actuations are monitored 35. Should the frequency of actuations be higher than a preset acceptable actuation frequency, the 'On' time for the solenoid is set to a greater rudder error point. Since AC solenoids are more susceptible to burn out with frequent actuations than are DC solenoids, the set-up menu has a different setting for AC and DC solenoids, AC solenoid actuations being set to a lower repetition rate.

The pump status includes, pump activation frequency information which is provided to an activation frequency monitor 35 wherein the frequency of solenoid actuations are monitored. Decisions are made 37 as to the acceptability of the frequency for the solenoids of the system. If the activation frequency is acceptable the system operation proceeds without modification. When a determination is made that the frequency of solenoid activation is higher than a preset acceptable actuation frequency, the rudder error turn "on" point is adjusted 39 by increasing the rudder error at which the solenoid is activated. This increase of the turn "on" point keeps the solenoid inactive for a longer period of time between activations, thus decreasing the activation frequency.

The position at which the rudder stops after a rudder order is given is monitored by a position overshoot monitor 41 and a position undershoot monitor 43, wherein the rudder order, coupled from the autopilot or helm, and the rudder stop position, provided by the rudder repeatback, are compared. A determination is made if an overshoot is within tolerance 45 or if an undershoot is within tolerance 47. If the overshoot or undershoot is within tolerance no further action is taken. Should an unacceptable overshoot occur, a reset program 49 resets the "off" error point at which the solenoid is deactivated by adding the amount of overshoot to the previous "off" point, thus turning the pump off sooner, thereby causing the rudder to stop at the ordered position. Similarly, should an unacceptable undershoot occur, a reset program 51 resets the "off" error point at which the solenoid is deactivated by subtracting the amount of undershoot from the previous "off" point, thus turning the pump off later, thereby causing the rudder to stop at the ordered position.

Figure 2:
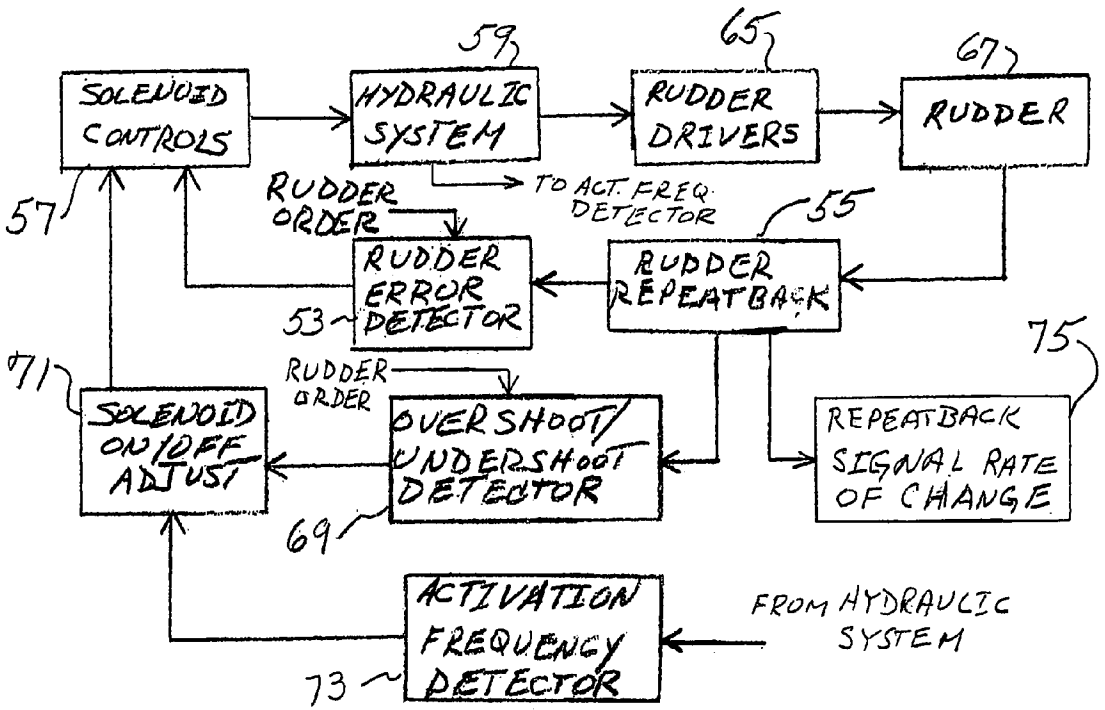
FIG. 2 is a block diagram of a rudder control incorporating the invention.
Figure 3:
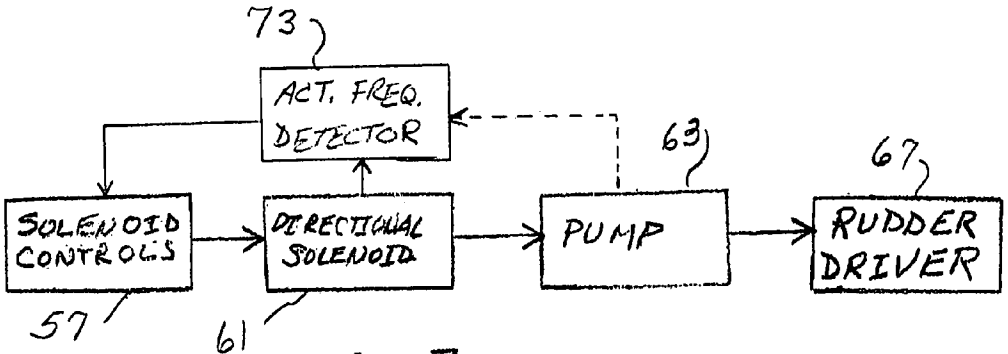
FIG. 3 is a block diagram useful for explaining the operation of the hydraulic system of FIG. 2.

Refer now to FIGS. 2 and 3 in which elements previously mentioned bear the same reference numerals. Rudder orders for a ship maneuver are communicated from an autopilot or helm to a rudder error detector 53 which determines the error between the rudder order and the rudder position received from a rudder repeatback 55. The error detected is coupled to solenoid controls 57 which control directional solenoids 61 in the hydraulic system 59 which respectively turn hydraulic pumps 63 on and off in accordance with the magnitude and direction of the rudder error. These hydraulic pumps cause rudder drivers 65 to position the rudder 67. The solenoid controls 57 are set to activate the directional solenoids when the detected error exceeds a predetermined "on" error point. After a directional solenoid has been activated its associated pump is turned on to cause a rudder driver 65 to drive the rudder 67 until a 0° error signal is detected. Since a rudder can not be stopped instantaneously, the directional solenoid 61 of the hydraulic system 59 are deactivated at a preselected turn "off" error point near 0° error, from which rudder movement continues until the rudder stops, at the desired position.

Rudder repeatback 55 communicates the position at which the rudder stopped to an overshoot/undershoot detector 69 to which the rudder order is also given. The overshoot or undershoot established by the overshoot/undershoot detector 69 is communicated to a solenoid "on""off" adjust 71 which resets the "off" error point in the solenoid controls 57, as will be explained.

To prolong the life of a solenoid, solenoid activation frequency is monitored by an activation frequency detector 73. The frequency may be determined by monitoring the activation frequency of the solenoid or turn on frequency of its associated pump. An acceptable activation frequency for the solenoid is stored in the solenoid "on/"off" adjust 71. If the detected activation frequency of the solenoid exceeds the stored frequency the rudder error turn "on" point is adjusted by increasing the rudder error at which the solenoid is activated. This increase of the turn "on" point keeps the solenoid inactive for a longer period of time between activations, thus decreasing the activation frequency.

Consider an "on" error of 0.8° and an "off" point of 0.2°. Should the rudder overshoot the ordered position by some amount, say 0.1°, indicating that the rudder has moved 0.3° after the pump was turned off instead of the expected 0.2°, the "off" point set in the solenoid controls 57 by the "on"/"off" adjust 71 would be increased to 0.3°. Thus if the rudder moves 0.3° after the pump is turned off, as expected, it will stop at the desired position for 0.0° of error. Should the rudder undershoot the rudder ordered position by −0.1°, indicating that the rudder was 0.1° short of the ordered rudder position, the "off"

point set in the solenoid controls 57 by the "on"/"off" adjust 71 would be decreased to 0.1°. Thus if the rudder moves 0.1° after the pump is turned off, as expected, it will stop at the desired position for 0.0° of error.

Short duration solenoid actuations do little to control the ruder and produce wear and tear on the machinery. When the activation frequency detector 73 senses an activation frequency greater than that stored in the "on"/"off" adjust 71, the "on" error position for solenoid activation in the solenoid controls 57 is increased. Considering the settings given above, the "on" point may be adjusted from 0.8° to a greater rudder error value such as 0.9° or more.

Repeatback signal rate of change 75 monitors the rate of change of the repeatback signal to determine if the signal rate is too fast or too slow relative to that expected. If either of these conditions is detected, a message is given to the bridge warning of a possible hydraulic system or rudder drive problem so that it may be addressed before it becomes crisis.

While the invention has been described in its preferred embodiments, it is to understood that the words that have been used are words of description rather than limitation and that changes may be made within the purview of the appended claims without departing from the true scope and spirit of the invention in its broader aspects.

I claim:

1. A method for positioning a rudder of a ship wherein the rudder is driven by a rudder drive system in accordance with a rudder error determined by the difference between a rudder position and a rudder order, the rudder drive system including a solenoid energized at a set rudder error, said solenoid coupled to an hydraulic pump which is activated when said solenoid is energized, comprising the steps of:

establishing an energizing frequency for solenoid burnout protection thereby providing a burnout protection frequency;

monitoring solenoid energizing frequency:

determining when said solenoid is being energized at an energizing frequency that exceeds said burnout protection frequency; and adjusting said set rudder error to a second set rudder error when said energizing frequency exceeds said burnout protection frequency.

2. A method in accordance with claim 1 wherein said second set rudder error is increased in said adjusting step.

3. A method in accordance with claim 1 wherein solenoid energizations are monitored to determine said energizing frequency in said determining step.

4. A method in accordance with claim 1 wherein hydraulic pump activations are monitored to determine said energizing frequency in said determining step.

5. A method for positioning a rudder of a ship in accordance with claim 1 further comprising the steps of:

determining a difference between a rudder order and a rudder stop position after said rudder drive system has achieved a turnoff point in response to said rudder order, thereby establishing a rudder position stopping error;

comparing said rudder position stopping error to a predetermined rudder position tolerance; and comparing said rubber position stopping error to a predetermined rubber position tolerance; and utilizing said rudder position stopping error, should said rudder position exceed said rudder position tolerance, to determine a corrected turnoff point for said rudder drive system such that said rudder stops at a position within said predetermined rudder position tolerance.

6. A method for positioning a rudder of a ship in accordance with claim 5 wherein said utilizing step includes the steps of:

decreasing said turnoff point when said rudder position stopping error indicates that said rudder has stopped short of said rudder order position; and increasing said turnoff point when said rudder position stopping error indicates that said rudder has stopped at a position that exceeds said rudder order position.

7. A method for positioning a rudder of a ship in accordance with claim 6 wherein said decreasing step includes the steps of:

subtracting said rudder position stopping error from said rudder stop position to provide an adjusted rudder turnoff point; and resetting said rudder turnoff point to said adjusted rudder turnoff point.

8. A method for positioning a rudder of a ship in accordance with claim 6 wherein said increasing step includes the steps of:

adding said rudder position stopping error to said rudder turnoff position to provide an adjusted rudder turnoff point; and resetting said rudder turnoff point to said adjusted rudder turnoff point.

9. A rudder positioning apparatus for a ship including an hydraulic system having solenoids energized at a set rudder position error, to activate pumps, of the hydraulic system, a rudder position error being determined by the difference between a rudder position and a rudder order, comprising:

a frequency detector coupled to said hydraulic system to determine frequency of said hydraulic system turn on, and a solenoid turn on adjuster coupled to said solenoid of said hydraulic system and said frequency detector for adjusting said set rudder position error when said frequency detector indicates that a predetermined frequency of solenoid energizations has been exceeded.

10. A rudder positioning apparatus in accordance with claim 9 wherein said frequency detector monitors activations of at least one solenoid in said hydraulic system.

11. A rudder positioning apparatus in accordance with claim 9 wherein said frequency detector monitors turn-ons of at least one pump in said hydraulic system.

12. A rudder positioning apparatus in accordance with claim 9 wherein said rudder position is provided by a rudder repeatback signal and further including a repeatback signal rate of change detector for monitoring operation of said rudder drive system.

13. A rudder positioning apparatus in accordance with claim 9 further including:

a rudder drive system that turns off at a turnoff point in response to a rudder order;

a rudder error detector that determines a difference between a rudder stop position, achieved after said turnoff point is reached, and said rudder order, thereby establishing a rudder stop position error; and a rudder position turnoff adjuster coupled to said rudder drive system and said rudder error detector for resetting said turnoff point in accordance with said rudder stop position error, thereby providing an adjusted turnoff point.

14. A rudder positioning apparatus in accordance with claim 13 wherein said rudder position turnoff adjuster resets said turnoff point by decreasing said turnoff point when said rudder stop position error indicates that an undershoot of said rudder order has occurred and increasing said turnoff point when said rudder stop position error indicates that an overshoot of said rudder order turnoff has occurred.

* * * * *